US006557467B1

(12) United States Patent
Dilling et al.

(10) Patent No.: US 6,557,467 B1
(45) Date of Patent: May 6, 2003

(54) PRINTING UNIT

(75) Inventors: Peer Dilling, Friedberg (DE); Horst Dauer, Rohrbach (DE); Josef Göttling, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/634,178

(22) Filed: Aug. 9, 2000

(30) Foreign Application Priority Data

Aug. 10, 1999 (DE) ..... 199 37 803

(51) Int. Cl.[7] ..... B41F 5/00

(52) U.S. Cl. ..... 101/220; 101/175; 101/176; 101/178; 101/478

(58) Field of Search ..... 101/175, 176, 101/178, 179, 180, 182, 183, 216, 217, 218, 219, 220, 221, 247, 153, 478

(56) References Cited

U.S. PATENT DOCUMENTS 5,806,427 A 9/1998 Niemiro et al.

6,085,650 A * 7/2000 Peterson ..... 101/220

FOREIGN PATENT DOCUMENTS

| | | |
|---|---|---|
| DE | 645 820 | 6/1937 |
| DE | 71 29 767 | 9/1972 |
| DE | 32 45 938 C2 | 6/1984 |
| DE | 94 21 111 | 6/1995 |
| DE | 195 40 149 C1 | 4/1997 |
| DE | 198 05 898 A1 | 11/1999 |

* cited by examiner

*Primary Examiner*—Andrew H. Hirshfeld
*Assistant Examiner*—Kevin D. Williams
(74) *Attorney, Agent, or Firm*—Cohen, Pontani, Lieberman & Pavane

(57) ABSTRACT

A printing unit is provided for a web-fed rotary printing machine, having a plurality of cylinders with associated drive motor, an additional device for printing an at least two guide elements. At least one cylinder is a plate cylinder. At least one guide element corresponds to the plate cylinder and is operably arranged in the printing unit for determining a setting path of the corresponding plate cylinder relative to the other cylinders. This guide element extends as far as the additional device for printing.

6 Claims, 5 Drawing Sheets

PRINTING UNIT

BACKGROUND OF THE INVENTION

FIELD OF THE INVENTION

The present invention relates to a printing unit for a web-fed rotary printing machine, having a number of printing unit cylinders which can be set in relation to one another on guide elements. Each cylinder has its own drive motor and at least one cylinder is a plate cylinder.

SUMMARY OF THE INVENTION

The object of the present invention is to provide a generic printing unit capable of bringing each plate cylinder into contact with an additional device needed for printing, using simple means and with high precision.

The present invention is a printing unit for a web-fed rotary printing machine having a plurality of cylinders with associated drive motors, an additional device for printing and at least two guide elements. At least one cylinder is a plate cylinder. At least one guide element corresponds to the plate cylinder and is operably arranged in the printing unit for determining a setting path of the corresponding plate cylinder relative to the other cylinders. This guide element extends as far as the additional device for printing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, embodiments of the present invention are illustrated in schematic form as follows.

DETAILED DESCRIPTION OF THE PRESENTLY PREFERRED EMBODIMENTS

Figure 1:
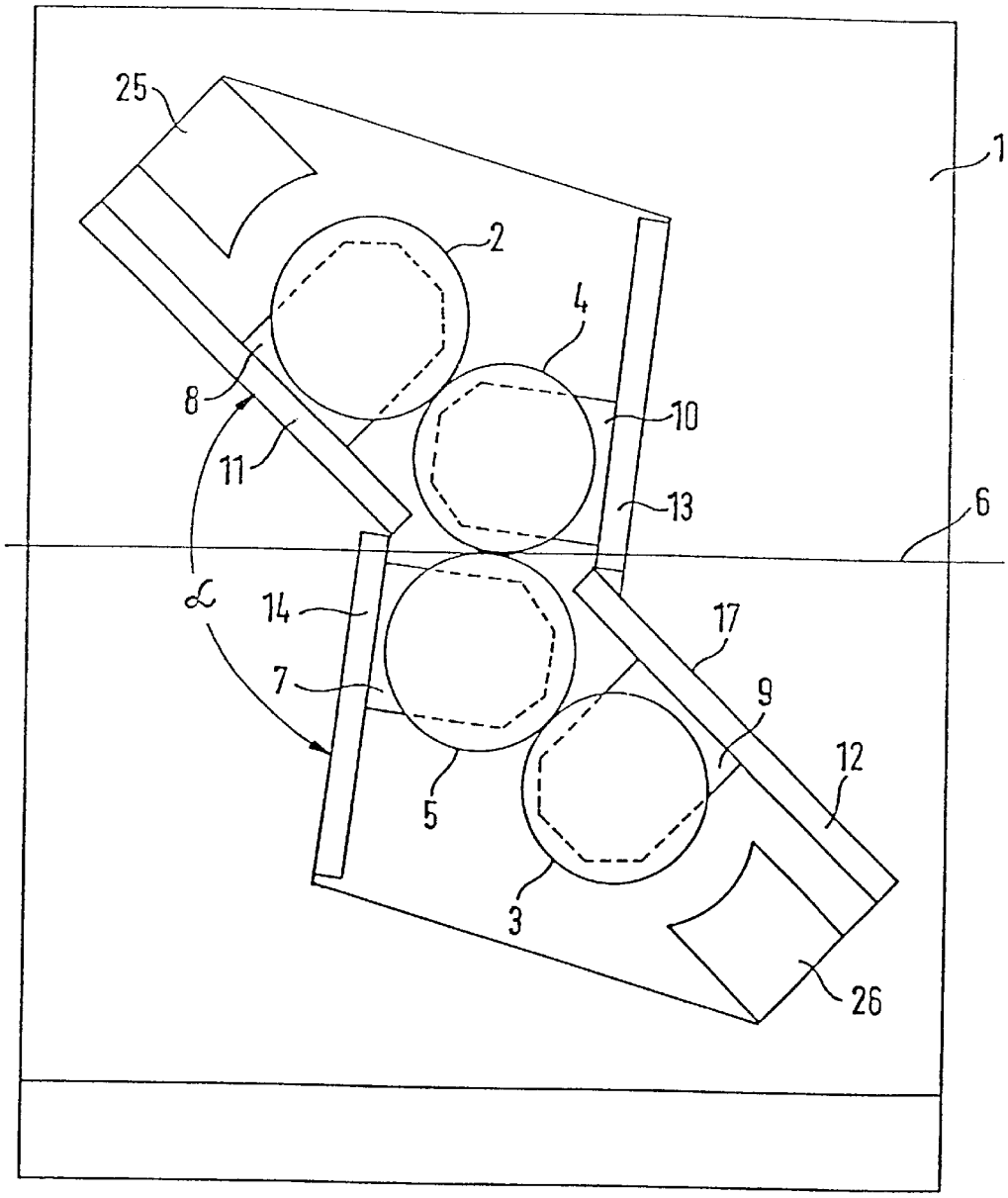
FIG. 1 is a side view of a first embodiment of the present invention.

Referring now to FIG. 1, a printing unit of the present invention is shown. The printing unit has a machine frame support 1 and four printing unit cylinders. The two outer cylinders are plate cylinders 2, 3 and the two inner cylinders are transfer cylinders 4, 5. A printing material web 6 runs between the transfer cylinders 4, 5 and is printed on both sides.

Each of the printing unit cylinders 2 to 6 is rotatably mounted in a carriage 7 to 10. Each of the carriages 7 to 10 accommodates a drive motor (not illustrated) for a printing unit cylinder. Examples of drive motors of this type are disclosed in U.S. patent application Ser. No. 09/635,155.

Guide elements 11–14 are provided to guide each carriage 7–10. In this case, the guide elements 11, 12 run parallel to one another as do the guide elements 13, 14. In addition, guide elements 11, 12 are inclined with respect to guide elements 13, 14 or are arranged in directions which deviate from each other. In the example illustrated, the printing-material web 6 runs horizontally. However, a vertical run of the web 6 is also possible by rotating the design arrangement by 90°. In principle, this also applies to the further examples and embodiments.

Figure 2:
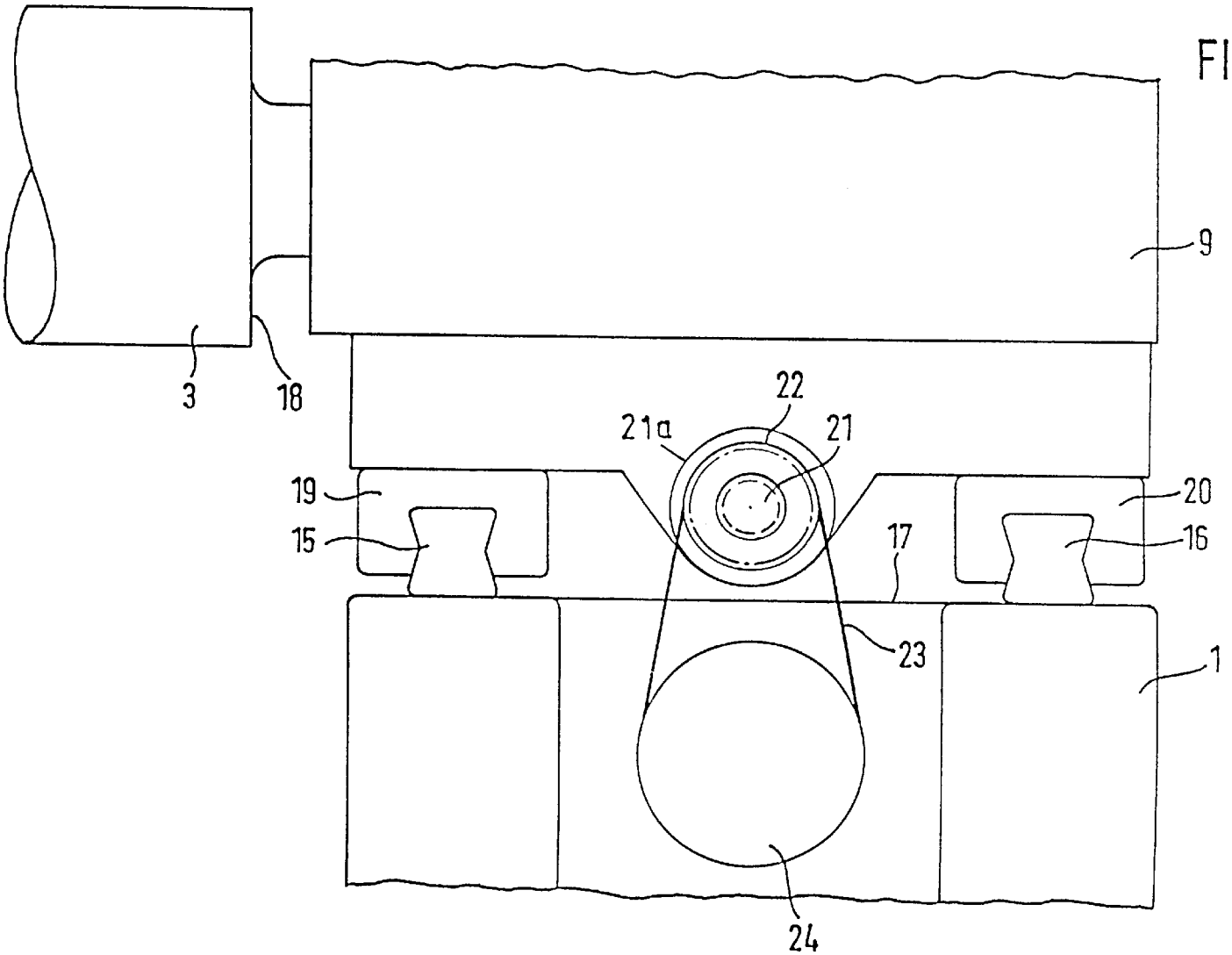
FIG. 2 is a partial section through the means for guiding and setting printing unit cylinder according to an embodiment of the present invention.

Referring now to FIG. 2, a further embodiment of the present invention is shown. The guide element 12 comprises two rectilinear, mutually parallel guide rails 15, 16, which are permanently fitted to one wall 17 of the machine frame support 1. The wall 17 in this case extends perpendicular to a plane drawn at the end 18 of the printing unit cylinder 3. Advantageously, each guide rail 15 and 16, has a dovetail like cross section, that engages a sliding shoe 19, 20. The sliding shoes 19, 20 are permanently fitted to the associated carriage 9.

In order to adjust the printing unit cylinder 3, the carriage 9 accommodates a threaded nut (indicated as 21*a* in FIG. 2), in which a screw spindle 21 engages. The screw spindle 21 is mounted on the machine frame support 1 so that it can be rotated but may not be axially displaced. A gear wheel 22 is fitted to the screw spindle 21 which is driven by a motor 24 via an intermediate gear system, such as a belt drive 23. Advantageously, the motor 24 is an electric setting motor. The motor 24 is also firmly connected to the machine frame support 1. The carriage 9 is moved along the guide rails 15, 16 forming its guide element 12 by means of rotation of the screw spindle 21. The further carriages 8, 10 and 11 are guided and driven in the same way.

As FIG. 1 also shows, the guide elements 13, 14 for the carriages 7 and 10 of the inner printing unit cylinders 4 and 5 are parallel to and spaced apart from each other. The guide elements 11, 12 for the carriages 8, 9 of the outer printing unit cylinders 2, 3 run obliquely with respect to the guide elements 13, 14 of the inner printing unit cylinders 4, 5. Here, the guide elements 11, 12 likewise run parallel to and spaced apart from each other. The difference in direction between the guides 11, 14 and 12, 13, respectively, is indicated by the angle $\alpha$. The adjustment movements of the outer printing unit cylinders 2, 3, are in the direction of the guide elements 11, 12, and are directed upward and downward, respectively. The adjustment movements become smaller as the angle $\alpha$ between the guide elements 11, 14 and 12, 13 decreases. The overall height of the printing unit illustrated in FIG. 1, with a printing material web 28 passing approximately horizontally, can therefore be minimized. If the printing unit is used with a vertical passage of the printing-material web, the width of the printing unit can be minimized.

If the printing unit cylinders 2 to 5 are not intended to be cantilever-mounted, an identical machine frame support must be arranged at the other end of the cylinders. An example of an arrangement of this type is described in U.S. patent application Ser. No. 09/635,155.

Referring again to FIG. 1, an additional device, in this instance an image setting device 25, 26, is arranged in the area of the ends of the guide elements 11, 12 facing away from the transfer cylinders 4, 5. The guide elements 11, 12 extend as far as the image setting devices. In this case, the image setting devices 25, 26 are permanently connected to the machine frame support 1. The guide elements 11, 12 serve dual function. First, they set the plate cylinders 2, 3 against the transfer cylinders 4, 5 for printing. Second, they guide the plate cylinders 2, 3 when they are set against the image setting devices 25, 26. Preferably, the arrangement allows the plate cylinders 2, 3 to be moved with respect to the image setting device in its image setting direction, i.e., the working direction of the image setting device. As a result of the rectilinear configuration of the guide elements, a high degree of guiding accuracy can be achieved without excessive production costs.

Alternatively, it is possible to accommodate the image setting devices 25, 26 on carriages which can be moved along guide elements, so that the image setting devices 25, 26 can be moved towards the respectively associated plate cylinder and vice versa. In this case, the plate cylinder 2, 3 can be moved with respect to the image setting device 25, 26 in its image setting direction and/or the image setting device 25, 26 can be moved with respect to the associated plate cylinder 43 in the direction of movement of the latter. Preferably, each plate cylinder and the associated image setting device are assigned the same guide elements here 11, 12, so that the aforementioned directions occur automatically.

FIG. 1 shows the printing unit cylinders in the print-on position. In order to transfer them into the print-off position or the image setting position, the plate cylinders 2, 3 are moved outwards along their guide elements 11, 12. The transfer cylinders 4, 5 are then displaced upwards and downwards, respectively, until all the printing unit cylinders have been lifted off one another. At the outer limit of the adjustment paths of the plate cylinders 2, 3, the latter then come into contact with the image setting devices 25, 26, which in this case are arranged to be stationary.

The printing unit cylinders 2 to 5 can also be replaced by printing unit cylinders having a smaller diameter. The more closely the angle $\alpha$ approaches 180°, the easier this is to do, while keeping the existing carriages on a single machine frame support. Where this is no longer possible, due to excessively large differences in diameter, an appropriately adapted machine frame support and/or appropriately adapted carriages will be used. In any case, if the frame supports are identical, the carriages assigned to the outer cylinders remain the same.

Figure 3:
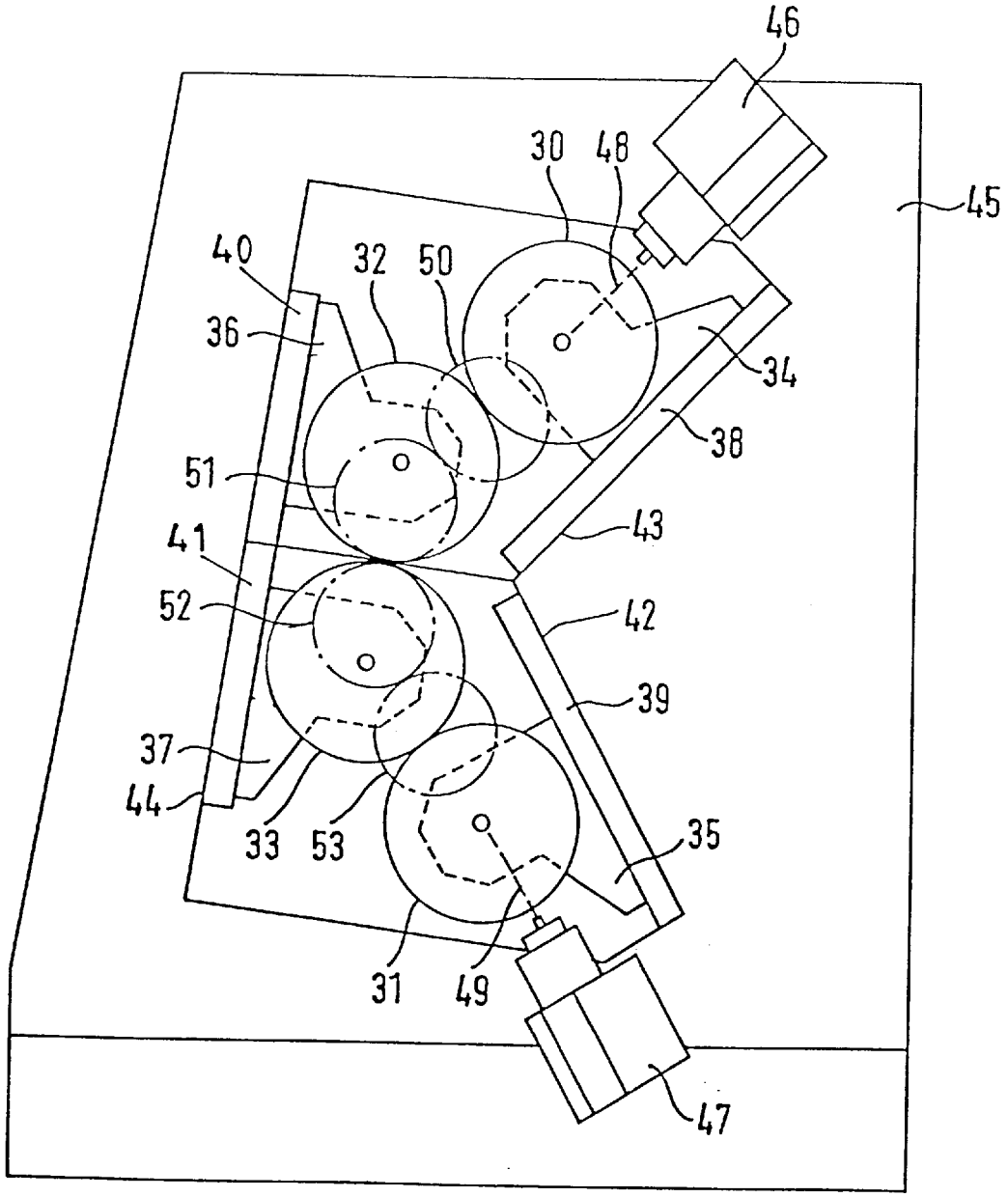
FIG. 3 is a second embodiment of the present invention.

Referring now to FIG. 3, a further embodiment of the present invention is shown. The printing unit according to FIG. 3 also has four printing unit cylinders, namely two plate cylinders 30, 31 and two transfer cylinders 32, 33, which are each rotatably mounted, on a carriage 34 to 37 that accommodates a drive motor (not shown). The carriages 34, 35 can be displaced here on rectilinear guide elements 38, 39 which run towards each other in a V shape. Provided for the carriages 36, 37 are mutually aligning, rectilinear guide elements 40, 41 at a distance in front of the tip of the guide elements 38, 39 which run towards each other in a V shape. All the guide elements are in turn provided on walls 42, 43, 44 of the machine frame support 45 which run perpendicular to the ends of the printing unit cylinders 30, 31, 36, 37. The present arrangement offers the advantage that only three walls 42, 43, 44 have to be machined.

The guide elements and the drive for setting the carriages 34 to 37 are designed in the same way as in the first embodiment. In this embodiment, a laser setting device 46, 47 is arranged in the area of the outer ends of the guide elements 38, 39 and is permanently fitted to the machine frame support 45. Each laser beam 48, 49 is directed parallel to the guide elements 38, 39 for the plate cylinders 30, 31, and in the direction of the axis of these cylinders. This makes replacing the printing unit cylinders with others having different diameters easier. In other words, the same machine frame support 45 and carriages 34 to 37, of the printing unit can also be equipped with printing unit cylinders 50 to 53 of smaller diameter.

In this embodiment, too, the plate cylinders 30, 31, starting from the "print on" position illustrated, can again be transferred into the image setting position by displacing the carriages 34, 35 outwards. No further adjusting movements are required. In this example, too, the image setting devices 46, 47 are arranged to be stationary. However, a mobile arrangement, as previously mentioned above in connection with the embodiment shown in FIG. 1, is also possible.

Figure 4:
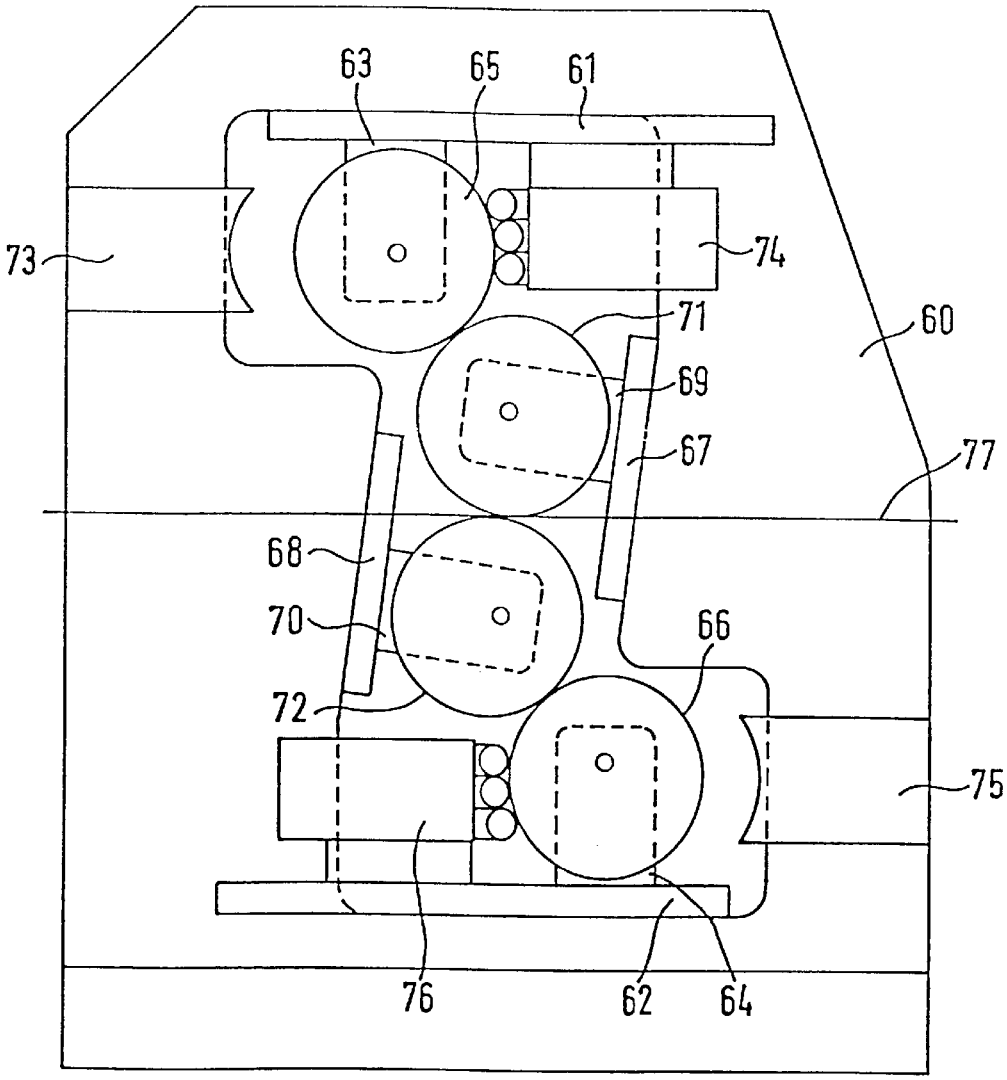
FIG. 4 is a third embodiment of the present invention.

Referring now to FIG. 4, another embodiment of the present invention is shown. The printing unit has four cylinders. A rectilinear guide element 61 is arranged on an upper area of a machine frame support 60. The rectilinear guide element 61 runs approximately parallel to the run of the printing-material web 77 (guided horizontally here) and is provided for a carriage 63 of a plate cylinder 65. A guide element 62 for a carriage 64 of a plate cylinder 66 is arranged in the lower area of the machine frame support 60. The two guide elements 61, 62 run parallel. At an angle advantageously differing only slightly from a right angle, between the guide elements 61, 62, two rectilinear guide elements 67, 68 for carriages 69, 70 of the transfer cylinders 71, 72 are provided, and arranged in planes which are parallel and spaced apart from each other. The directions of the guide elements 61, 62 and 67, 68 are thus at an angle to one another.

Also permanently installed in the upper area of the machine frame support 60 is an image setting device 73, with which the plate cylinder 65 can be brought into contact by displacing its carriage 63 to one end of the guide element 61. In this case, the plate cylinder 65 simultaneously lifts off the transfer cylinder 71. An inking unit 74 is also capable of being moved on the guide element 61. In the print on position shown in FIG. 4, the inking unit 74 can be set against the plate cylinder 65. In the same way, an image setting device 75 is permanently fixed to the machine frame support 60, in front of one end of the guide element 62, and an inking unit 76 is arranged such that it can be displaced on the guide element 62. The image setting device 75 and the inking unit 76 cooperate with the plate cylinder 66.

In order to transfer the printing unit cylinders of each printing unit into the "print off" position, the plate cylinders 65, 66 are first moved in the direction of the image setting devices 73, 75. The inking units 74, are simultaneously moved in the opposite direction, in order to create space for the transfer cylinders 71, 72, which then have to be moved away from each other. In this position, if the printing cylinder units are cantilever mounted on the machine frame support 60, sleeves on the plate cylinders 65, 66 can be changed. If the printing unit cylinders are guided at both ends on a machine frame support then, one of the supports has to be folded out or moved out, for example, as is described in U.S. patent application Ser. No. 09/635,155.

In the present printing unit, the guide elements 61, 62 perform three functions; first, they set the plate cylinders 65, 66 onto and away from the transfer cylinders 71, 72; second, they guide the plate cylinders 65, 66 as they are brought into engagement with the image setting devices 73, 75; and finally, they guide the inking units 74, 76.

Although here the image setting devices 73, 75 in the example illustrated are arranged to be fixed, it is also possible to guide these devices, just like the inking units 74, 76, so that they are displaceable on the guide elements 61, 62 which extend as far as these additional devices. In addition, the relative motion of the image setting devices 74 and the cylinders as has been discussed earlier regarding the previous embodiment also applies to the directions of the respective movements in this case.

Figure 5:
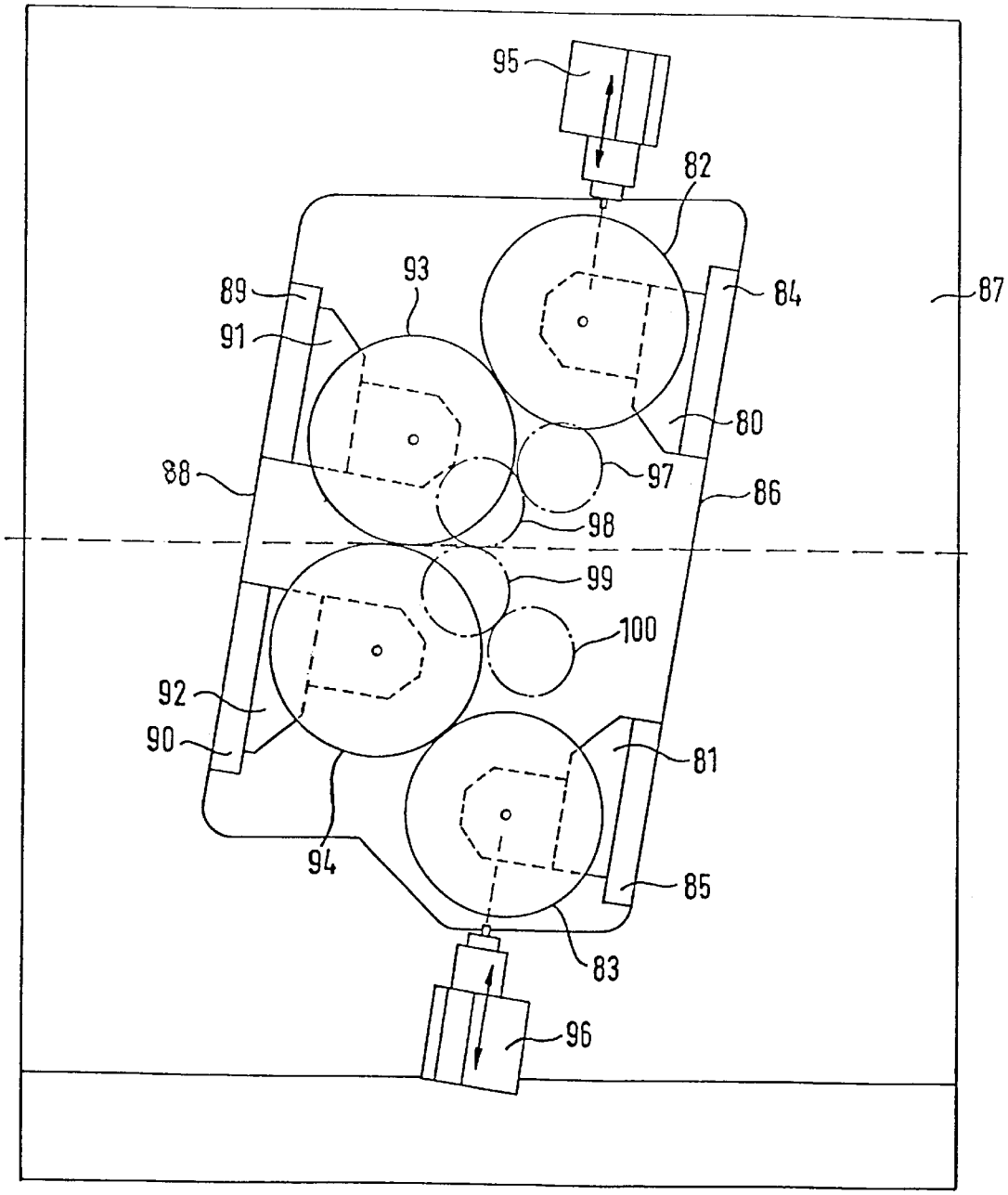
FIG. 5 is a fourth embodiment of the present invention.

Referring now to FIG. 5, a further example is shown. In this embodiment, the carriages 80, 81 for the plate cylinders 82, 83 are accommodated on mutually aligned, rectilinear guide elements 84, 85, which are permanently connected to one wall 86 of the machine frame support 87. Further mutually aligned, rectilinear guide elements 89, 90 for carriages 91, 92 of the transfer cylinders 93, 94 are fixed to an opposite wall 88, parallel to the guide elements 84, 85.

Of course, it is also possible to arrange the guides for a plate cylinder and the transfer cylinder so that they do not cooperate on the walls 86, 88. For example, it is possible to arrange the guides 84 and 90 on the wall 86 and the guides 85 and 89 on the wall 88.

An image setting device 95, 96 is fitted above the plate cylinder 82 and below the plate cylinder 83, respectively. These devices can be fitted permanently to the machine frame 87. In this case, the plate cylinders 82, 83 will be moved on the guides 84, 85 towards the image setting device 95, 96, with the distance being covered by this movement alone. The guides 84, 85 are therefore designed to be appropriately long. However, it is also possible to arrange the image setting devices 95, 96 in such a way that these can be moved towards the plate cylinders 82, 83, as is indicated by directional arrows in FIG. 5. For this purpose, the image setting devices can be accommodated on their own carriages, and be capable of being moved on their own guides or the guides 84, 85. Another option is to accommodate the image setting devices 95, 96 on associated telescopic cylinders, etc., fixed to the machine frame.

With regard to the directions of movement, the previously discussed arrangement for relative motion of the image setting devices and cylinders applies here as well. In each case, it is expedient to have an arrangement in which the plate cylinder can be moved with respect to the associated image setting device in its image setting direction. In addition, the image setting device can be moved with respect to the associated plate cylinder, in the direction of movement of the associated cylinder or both movements can occur.

The arrangement according to FIG. 5 is a simple structure, in that only two parallel walls of the machine frame support 87 have to be machined.

As FIG. 5 further shows, it is also possible for printing unit cylinders 97 to 100, which have a smaller diameter, to be used in the machine frame support 87. In this case, the carriages 80, 81 for the plate cylinders can be transferred unchanged, since the optical axis of the image setting devices 95, 96 and the axis of the respectively associated plate cylinder 82, 83 lie in one plane, and the mutual relative movement runs in the image setting direction. For the printing unit cylinders 98, 99, on the other hand, higher carriages are used in the example illustrated. The machine frame support or supports can be kept. However, the present structure offers the option for the diameters of the cylinders, and hence the format, to be varied within a relatively large range, without having to replace the carriages for the inner cylinders.

The printing unit of the present invention provides a large capacity for a high variability in format while only needing one guide.

The additional device needed for printing could also be a combined inking/damping unit or only a damping unit for offset printing.

As the above description shows, the invention is not restricted to the embodiments illustrated. In particular, it is possible to provide an approximately vertical web run instead of an approximately horizontal web run. For this purpose, the guide elements simply have to be provided in a position rotated through 90°.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. A printing unit for a web fed rotary printing machine, comprising:

a plurality of driven cylinders, wherein at least one cylinder is a plate cylinder;

an additional device for printing; and at least two guide elements, at least one guide element is operably arranged in the printing unit for determining a setting path of the plate cylinder relative to the other cylinders, and extending the guide elements as far as the additional device for printing, the additional device being movable up to an associated plate cylinder on one of the guide elements, the additional device and the plate cylinder being movable on a common guide element.

2. A printing unit for a web fed rotary printing machine, comprising:

a plurality of driven cylinders, wherein at least one cylinder is a plate cylinder;

an additional device for printing;

at least two guide elements, at least one guide element is operably arranged in the printing unit for determining a setting path of the plate cylinder relative to the other cylinders, and extending the guide elements as far as the additional device for printing;

at least one carriage, wherein the plurality of cylinders comprises outer printing unit cylinders and inner printing unit cylinders, each having a corresponding carriage; and the at least two guide elements comprise a first set of guide elements for determining setting paths of the carriages corresponding to the outer printing unit cylinders and a second set of guide elements for determining setting paths of the carriages for the inner printing unit cylinders, wherein the first set of guide elements. are arranged obliquely with respect to the second set of guide elements.

3. The printing unit according to claim 2, wherein the first set of guide elements are arranged in a V shape.

4. The printing unit according to claim 3, wherein the second set of guide elements are linearly aligned.

5. A printing unit for a web fed rotary printing machine, comprising:

a plurality of driven cylinders, wherein at least one cylinder is a plate cylinder;

an additional device for printing;

at least two guide elements, at least one guide element is operably arranged in the printing unit for determining a setting path of the plate cylinder relative to the other cylinders, and extending the guide elements as far as the additional device for printing, the at least one guide element comprising a first set of guide elements and a second set of guide elements;

at least one machine frame support;

a plurality of carriages movably arranged on the first and second sets of guide elements, wherein the guide elements are mounted on the frame support, the cylinders being mounted in the carriages, and the first set of guide elements being arranged opposite and parallel to the second set of guide elements, the plurality of cylinders includes a set of two transfer cylinders, the at least one plate cylinder including two plate cylinders; and a first wall and a second wall arranged opposite one another and being part of the machine frame support, wherein the transfer cylinders are arranged on the first wall and the plate cylinders are arranged on the second wall.

6. A printing unit for a web fed rotary printing machine, comprising:

a plurality of driven cylinders, wherein at least one cylinder is a plate cylinder;

an additional device for printing;

at least two guide elements, at least one guide element is operably arranged in the printing unit for determining a setting path of the plate cylinder relative to the other cylinders, and extending the guide elements as far as the additional device for printing, the plurality of cylinders includes a set of two transfer cylinders, the at least one plate cylinder including two plate cylinders;

at least one machine frame support; and a plurality of carriages movably arranged on the first and second sets of guide elements, wherein the guide elements are mounted on the frame support, the cylinders being mounted in the carriages, and the first set of guide elements being arranged opposite and parallel to the second set of guide elements, the plurality of cylinders comprising a set of inner transfer cylinders and a set of outer plate cylinders and the at least two guide elements comprising guide elements for the outer printing unit cylinders which run approximately parallel to a printing material web fed between the inner transfer cylinders.

* * * * *